US010457370B1

(12) United States Patent
Poirier et al.

(10) Patent No.: US 10,457,370 B1
(45) Date of Patent: Oct. 29, 2019

(54) MARINE STEERING SYSTEM AND METHOD OF PROVIDING STEERING FEEDBACK

(71) Applicant: Brunswick Corporation, Lake Forest, IL (US)

(72) Inventors: Brian J. Poirier, Fond du Lac, WI (US); Scott M. Westpfahl, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 105 days.

(21) Appl. No.: 15/355,661

(22) Filed: Nov. 18, 2016

(51) Int. Cl.
*B63H 21/21* (2006.01)
*B63H 25/02* (2006.01)

(52) U.S. Cl.
CPC ..... *B63H 21/21* (2013.01); *B63H 25/02* (2013.01); *B63H 2021/216* (2013.01); *B63H 2025/022* (2013.01)

(58) Field of Classification Search
CPC .. B63H 21/21; B63H 25/02; B63H 2021/216; B63H 2025/022
See application file for complete search history.

(56) References Cited

U.S. PATENT DOCUMENTS 6,108,599 A * 8/2000 Yamamoto ..... B62D 6/00 180/422
6,273,771 B1 8/2001 Buckley et al.
7,063,030 B2 6/2006 Mizutani
7,263,943 B2 9/2007 Takada et al.
7,267,069 B2 9/2007 Mizutani
7,270,068 B2 9/2007 Mizutani
7,465,200 B2 12/2008 Mizutani
7,727,036 B1 6/2010 Poorman et al.
7,941,253 B1 5/2011 Brant
7,997,222 B2 8/2011 Hiroshima et al.
8,056,497 B1 11/2011 Rondeau et al.
9,272,764 B2 3/2016 Bamba
2001/0032749 A1 10/2001 Thomas et al.
2005/0050871 A1 3/2005 Wuertz et al.
(Continued)

FOREIGN PATENT DOCUMENTS

JP 2007137287 A * 6/2007

OTHER PUBLICATIONS

Translation of JP2007137287A (Kanda et al.) obtained via Espacenet on Mar. 28, 2019 (Year: 2007).*
Unpublished U.S. Appl. No. 15/190,620, filed Jun. 23, 2016.

*Primary Examiner* — Jeffrey C Boomer
(74) *Attorney, Agent, or Firm* — Andrus Intellectual Property Law, LLP

(57) ABSTRACT

A steering system on a marine vessel includes a steering wheel movable by a vessel operator to steer the marine vessel and a variable resistance device controllable to apply a variable resistance amount to resist movement of the steering wheel. The system includes a control unit that controls the variable resistance device to determine a baseline resistance amount based on vessel speed and/or engine RPM and detect at least a threshold change in angular position of the marine vessel. The control unit then controls the variable resistance device to prevent a decrease in the resistance amount below the baseline resistance amount or to increase the resistance amount above the baseline resistance amount.

20 Claims, 5 Drawing Sheets

(56) References Cited

U.S. PATENT DOCUMENTS

| | | | | |
|---|---|---|---|---|
| 2005/0181687 | A1* | 8/2005 | Okumura | B63H 20/12 440/53 |
| 2005/0199167 | A1* | 9/2005 | Mizutani | B63H 25/02 114/144 R |
| 2005/0199168 | A1* | 9/2005 | Mizutani | B63H 25/02 114/144 R |
| 2006/0240720 | A1 | 10/2006 | Yamashita et al. | |
| 2007/0066156 | A1* | 3/2007 | Mizutani | B63H 20/12 440/59 |
| 2007/0289837 | A1 | 12/2007 | Wheals | |
| 2008/0210148 | A1* | 9/2008 | Mizutani | B63H 20/12 114/144 RE |
| 2009/0176418 | A1* | 7/2009 | Mizutani | B63H 21/213 440/53 |
| 2009/0188226 | A1* | 7/2009 | Carlson | A01D 34/64 56/10.2 R |
| 2009/0198414 | A1 | 8/2009 | Mohning et al. | |
| 2009/0266658 | A1 | 10/2009 | Lueker, Jr. | |
| 2010/0206208 | A1* | 8/2010 | Zanfei | B63H 25/24 114/144 RE |
| 2012/0232727 | A1 | 9/2012 | Iwata et al. | |
| 2013/0252490 | A1* | 9/2013 | Kinoshita | B63H 11/00 440/1 |
| 2014/0343697 | A1 | 11/2014 | Kuipers | |
| 2015/0025744 | A1* | 1/2015 | Banno | B62D 6/04 701/41 |
| 2016/0318592 | A1* | 11/2016 | Mizutani | B63H 20/12 |
| 2018/0237096 | A1* | 8/2018 | Zhu | B62H 1/10 |

* cited by examiner

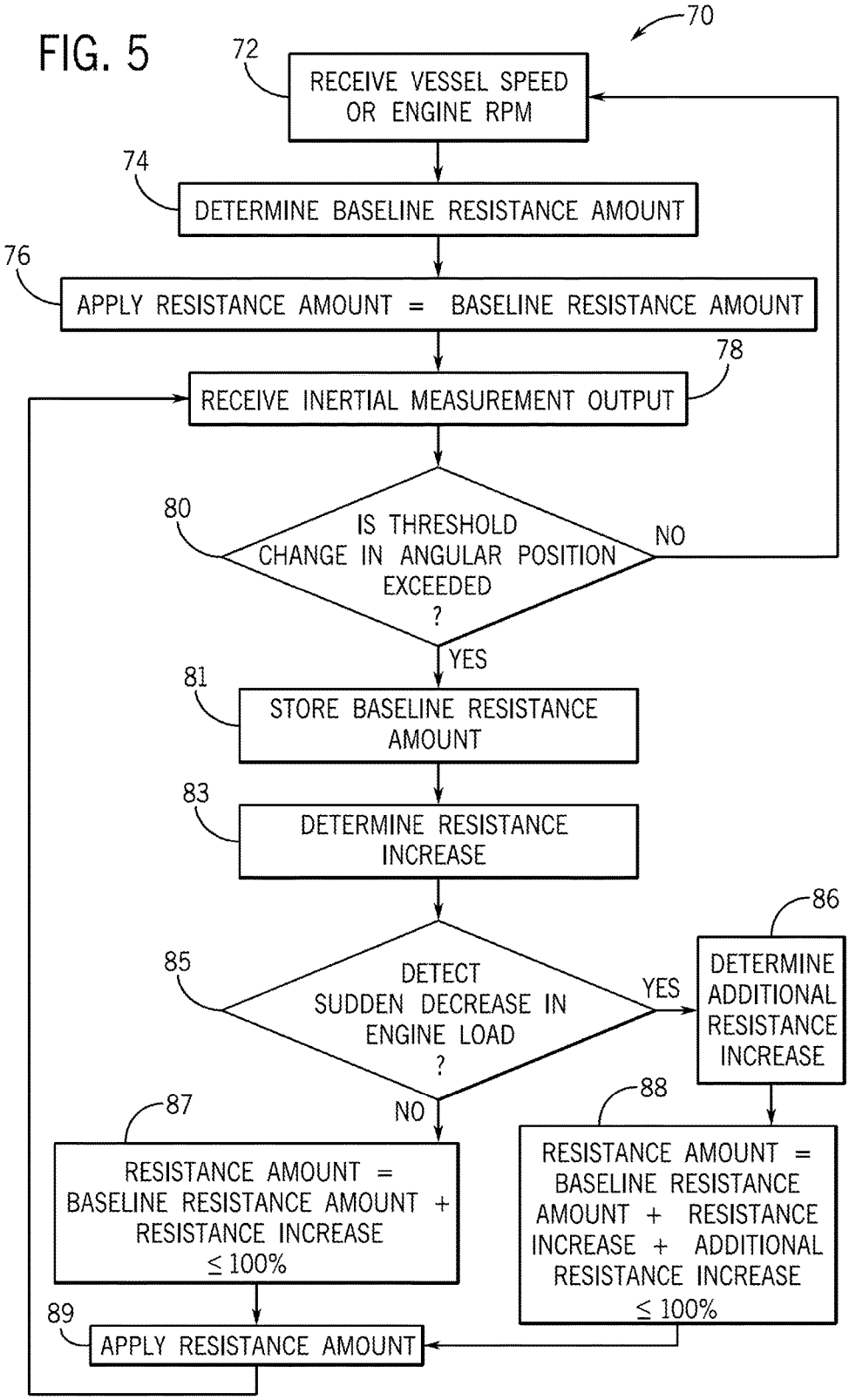
FIG. 5
70
72
RECEIVE VESSEL SPEED OR ENGINE RPM
74
DETERMINE BASELINE RESISTANCE AMOUNT
76
APPLY RESISTANCE AMOUNT = BASELINE RESISTANCE AMOUNT
78
RECEIVE INERTIAL MEASUREMENT OUTPUT
80
IS THRESHOLD CHANGE IN ANGULAR POSITION EXCEEDED ?
NO
YES
81
STORE BASELINE RESISTANCE AMOUNT
83
DETERMINE RESISTANCE INCREASE
85
DETECT SUDDEN DECREASE IN ENGINE LOAD ?
YES
86
DETERMINE ADDITIONAL RESISTANCE INCREASE
NO
87
RESISTANCE AMOUNT = BASELINE RESISTANCE AMOUNT + RESISTANCE INCREASE ≤ 100%
88
RESISTANCE AMOUNT = BASELINE RESISTANCE AMOUNT + RESISTANCE INCREASE + ADDITIONAL RESISTANCE INCREASE ≤ 100%
89
APPLY RESISTANCE AMOUNT

MARINE STEERING SYSTEM AND METHOD OF PROVIDING STEERING FEEDBACK

FIELD

The present disclosure generally relates to steering systems on marine vessels, and more specifically to methods and systems for providing steering feedback on drive-by-wire steering systems on a marine vessel.

BACKGROUND

U.S. Pat. No. 6,273,771, incorporated by reference herein in its entirety, discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,727,036, incorporated by reference herein in its entirety, discloses a system and method for controlling movement of a marine vessel. An operator controllable device outputs a signal that is representative of an operator-desired rate of position change of the vessel about or along an axis. A sensor outputs a signal that is representative of a sensed actual rate of position change of the vessel about or along the axis. A rate of position change controller outputs a rate of position change command based upon the difference between the desired rate of position change and the sensed rate of position change. A vessel coordination controller controls movement of the vessel based upon the rate of position change command.

U.S. Pat. No. 7,941,253, incorporated by reference herein in its entirety, discloses a marine propulsion drive-by-wire control system that controls multiple marine engines, each one having one or more PCMs, i.e. propulsion control modules, for controlling engine functions which may include steering or vessel vectoring. A helm has multiple ECUs, electronic control units, for controlling the multiple marine engines. A CAN, controller area network, bus connects the ECUs and PCMs with multiple PCM and ECU buses. The ECU buses are connected through respective isolation circuits isolating the respective ECU bus from spurious signals in another ECU bus.

U.S. Pat. No. 9,272,764, incorporated by reference herein in its entirety, discloses a remote control device for a vessel that is installed in a vessel and remotely controls a vessel propulsion device of the vessel. The remote control device includes an operation member, an operation load applying mechanism, a control section, and an actuator. The operation member is supported rotatably around a rotation axis, and is operated by an operator to switch the shift position of a forward-reverse switching mechanism in the vessel propulsion device according to the operation angle of the operation member. The operation load applying mechanism applies an operation load to the operation member. The control section controls the operation load. The operation load applying mechanism includes an actuator that adjusts the operation load. The control section is arranged to control the actuator based on a vessel speed of the vessel.

Unpublished U.S. patent application Ser. No. 15/190,620, filed Jun. 23, 2016, and assigned to the Applicant of the present application, incorporated by reference herein in its entirety, discloses a drive-by-wire control system for steering a propulsion device on a marine vessel that includes a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a steering system on a marine vessel includes a steering wheel movable by a vessel operator to steer the marine vessel and a variable resistance device controllable to apply a variable resistance amount to resist movement of the steering wheel. The system includes a control unit that controls the variable resistance device to determine a baseline resistance amount based on vessel speed and/or engine RPM and detect at least a threshold change in angular position of the marine vessel. The control unit then controls the variable resistance device to prevent a decrease in the resistance amount below the baseline resistance amount.

One embodiment of providing steering feedback on a steering wheel of a marine vessel includes determining a baseline resistance amount based on the vessel speed and/or the engine RPM, and controlling a variable resistance device to apply the baseline resistance amount to resist movement of the steering wheel. At least a threshold change in angular position of the marine vessel is detected, and then the method includes controlling the variable resistance device to apply a resistance amount greater than or equal to the baseline resistance amount.

Various other features, objects, and advantages of the invention will be made apparent from the following description taken together with the drawings.

BRIEF DESCRIPTION OF THE DRAWINGS

The present disclosure is described with reference to the following Figures.

FIG. 5 is a flow diagram depicting another embodiment of a method of providing steering feedback on a steering wheel of a marine vessel.

DETAILED DESCRIPTION

Figure 1:
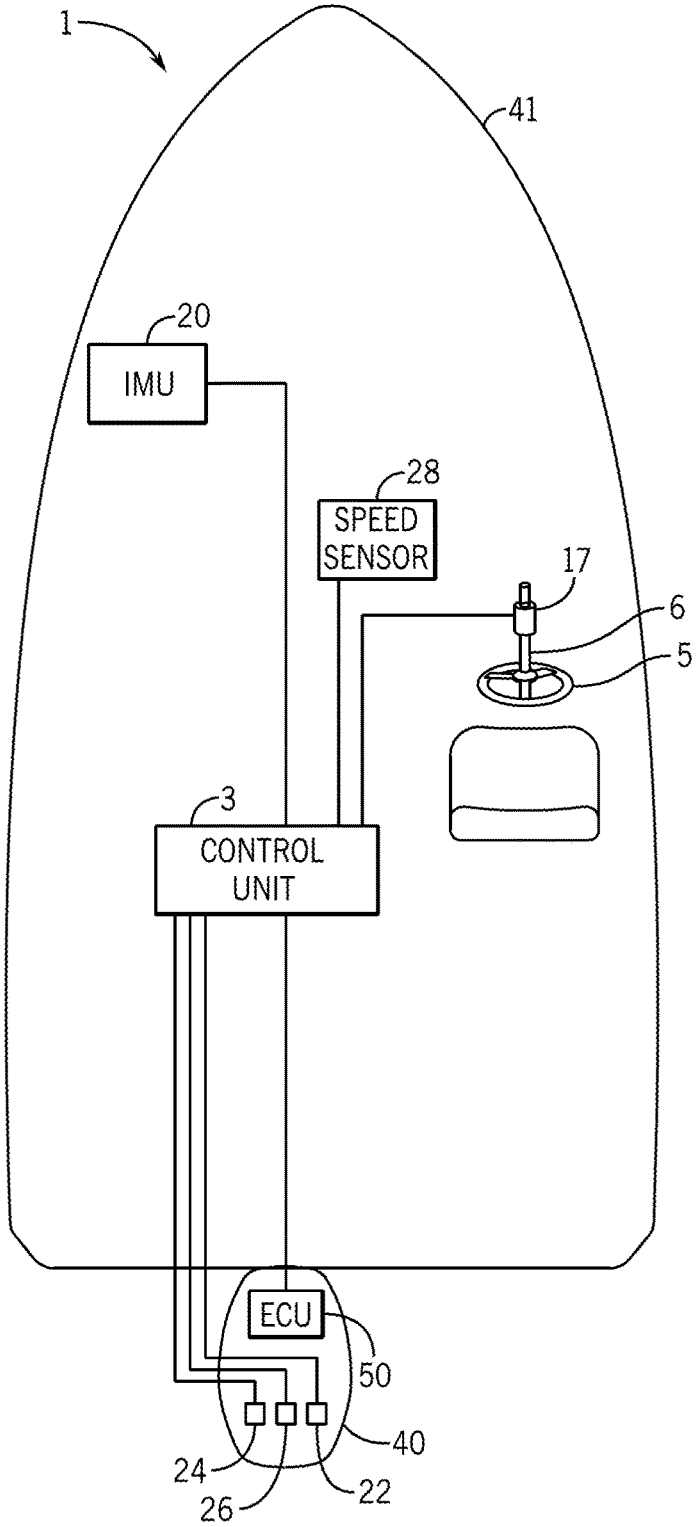
FIG. 1 is a schematic diagram of one embodiment of a steering system on a marine vessel.

Conventional mechanical and/or hydraulic steering systems for marine vessels advantageously provide direct tactile feedback to a user regarding operating conditions experienced by the propulsion device. The tactile feedback is transmitted via hydraulic and/or mechanical linkages between the user input device, the steering system, and the propulsion device(s). The present inventors have recognized that due to a delay in perceivable heading change of the marine vessel, most users rely on this tactile feedback instead of their own visual perception of the vessel's heading.

In drive-by-wire systems, the user input device (such as the steering wheel) and steering actuator(s) electronically communicate and are not connected by hydraulic or mechanical linkages. Thus, they do not provide mechanical feedback to drivers. The present inventors have recognized that current drive-by-wire steering systems are insufficient and do not provide tactile feedback that enables the user to intuitively understand and account for the conditions experienced by the propulsion device(s) on the marine vessel. The present inventors have also recognized that providing insufficient or inaccurate feedback on a steering input device, such as a steering wheel, is disadvantageous and can cause a user to unintentionally overcorrect or undercorrect steering input due to an inability to judge the heading change associated with a particular steering input. Further, the present inventors have recognized that users are dissatisfied with currently available drive-by-wire steering systems because the feedback provided is unsatisfactory, as it does not consistently or accurately correlate with what the marine vessel is doing or with the conditions experienced by the propulsion device.

The inaccuracy of the feedback mechanisms and control on such currently-available drive-by-wire systems yields a numb or disconnected steering feeling for the user. For example, the present inventors have recognized that drive-by-wire systems that provide steering feedback based on speed, such as vessel speed, are insufficient because vessel speed does not account for all conditions of the boat where steering feedback is desired or expected by a user. In general, such speed-based drive-by-wire steering control systems provide less steering resistance at slower speeds, and more steering resistance at higher speeds. Thus, steering at slower speeds requires less effort from the user than steering at high speeds. While this may provide the expected feedback during some operating conditions, there are situations where the expected steering feedback does not correlate with speed. For example, a vessel may lose speed during a turn or during other steering-intensive maneuvers, such as wave hopping. In a speed-based drive-by-wire control system, steering resistance would be is reduced when the vessel loses speed resulting in a reduction of the required steering effort in the middle of a steering maneuver. This is the opposite of what a user expects and is not in line with what is experienced by the propulsion device on the marine vessel, and may result in an oversteer or understeer situation.

In other embodiments where steering feedback is based on steering load, such as a load acting on the propulsion device or a load experienced by a steering actuator, the feedback system underperforms because steering load does not always indicate or account for all steering conditions. For example, steering load can be affected by various outside influences that do not provide an accurate representation of how the vessel is behaving. The steering system could have a failed part, could have a pinched hydraulic line, or could have something stuck in the steering system on the engine. All of this will increase the steering loads, but the vessel may not be changing speed or changing direction. In such instances where steering load is not an accurate reflection of vessel performance/attitude, the steering feedback would be unnatural and confusing to a user.

Accordingly, the present inventors have endeavored to provide systems and methods that overcome the shortcomings of the prior art. More specifically, the present inventors have endeavored to provide systems and methods for delivering tactile steering feedback in the form of steering resistance that better accounts for the operating conditions of the marine vessel and the propulsion device. Through research and development, the present inventors have arrived at the following examples, which include both systems and methods for calculating and providing such steering feedback to a user operating a steering wheel 5 of a marine vessel 41. In various embodiments, a control unit 3 is provided that determines a steering resistance amount applied by a variable resistance device 17 on the steering wheel 5 based on speed and vessel dynamics, such as based on output of an inertial measurement unit (IMU) 20 detecting a threshold change in pitch, roll, or yaw. Additionally, in some embodiments the control unit 3 further modifies the steering feedback based on detection of a threshold drop in engine load. Accordingly, a control unit 3 controls a variable resistance device associated with the steering wheel 5 of the marine vessel 41 based on the speed and sensed vessel dynamics to provide accurate steering feedback, especially during a turn or during steering maneuvers in wavy conditions. Accordingly, in such an embodiment the steering feedback provided can account for a situation such as propeller cavitation or venting or wave hopping, where a sudden decrease in vessel speed or a sudden increase in engine speed may occur, but do not track the appropriate steering feedback expected by the user.

Figure 2:
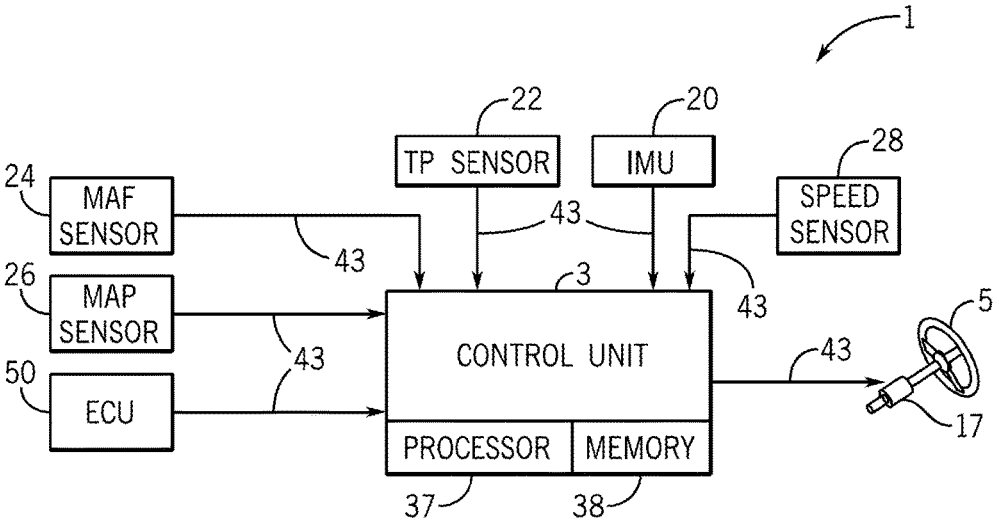
FIG. 2 is a schematic diagram of another embodiment of a steering system on a marine vessel.

FIGS. 1 and 2 depict embodiments of a drive-by-wire steering system 1 for steering one or more propulsion devices 40 on a marine vessel 2. The propulsion device 40 is associated with an engine control unit (ECU) 50 providing output signals to control the operation of various components related to the internal combustion engine of the propulsion device 40 used to provide thrust for the marine vessel 41. It should be noted that while FIG. 1 depicts a single propulsion device 40 the system 1 may incorporate any number of one or more propulsion devices 40. The propulsion device(s) 40 in the depicted embodiments is an outboard motor; however, in other embodiments the propulsion device(s) 40 may be a stern drive, a pod drive, or any other propulsion device for a marine vessel. The steering system 1 includes a steering wheel 5 for controlling the steering position of the propulsion device 40, and thus to steer the marine vessel 41. A variable resistance device 17 is associated with the steering wheel 5 and is controllable to vary resistance to movement of the steering wheel 5.

In the depicted embodiment, the variable resistance device 17 enacts a resistance on the steering shaft 6 portion of the steering wheel 5. The variable resistance device 17 may include any of various types of electrical, mechanical, and/or hydraulic devices operable to variably resist (e.g., restrict and/or brake) movement of the steering wheel 5. Exemplary variable resistance devices 17 include any one or more of a magnetorheological (MR) device, an electric brake (such as but not limited to an electromagnetic or mechanical contact brake), an electromagnet hysteresis brake, a permanent magnet hysteresis brake, a direct-connected servo or stepper motor, a hydraulic cylinder, a linear actuator, a mechanical friction slip clutch, or the like. To provide just one specific exemplary arrangement, the variable resistance device 17 may include an electric motor or a hydraulic pump that powers a mechanical clamp or other similar device that directly or indirectly engages the steering shaft 6 to resist its rotational movement, either in the clockwise, counterclockwise, or both rotational directions. In an alternative embodiment, the variable resistance device 17 is an MR fluid braking mechanism attached to the steering shaft 6 and applying a variable resistance force thereon in response to a varying magnetic field.

The variable resistance device 17 is controlled by control unit 3 to effectuate an appropriate steering feedback, or resistance amount, based on speed, which may be the speed of the marine vessel 41 (i.e., vessel speed) or the engine speed of the engine in the propulsion device 40 (i.e. engine RPM), and the sensed vessel dynamics, such as inertial measurement output from an IMU 20 indicating linear and angular motion of the marine vessel 41. For example, the IMU 20 may include one or more of a three-axis gyroscope, a three-axis accelerometer, and a magnetic compass, or a three-axis magnetometer. In such an embodiment, the inertial measurement output of the IMU indicates a pitch, roll, and yaw of the marine vessel and/or a change in pitch, roll, and/or yaw of the marine vessel. In other embodiments, the IMU 20 may be configured to sense position and/or movement in only one or two axes, such as roll and/or pitch of the marine vessel. The control unit 3 is configured to adjust the resistance amount applied by the variable resistance device 17 accordingly. In other words, an unstable condition is indicated if the measurement values from the IMU 20 indicate that the vessel is rocking or otherwise changing in angular position at a rate that would cause an unstable condition for the vessel operator where the vessel operator would expect or desire stiffer steering, i.e. an increase in steering resistance.

Accordingly, the control unit 3 is operatively connected to the various elements of the steering system 1, which may include a speed sensor 28 to determine a vessel speed, an IMU 20 measuring angular motion of the marine vessel 41, and the variable resistance device 17. The control unit 3 may determine a baseline resistance amount based on vessel speed sensed by the speed sensor 28. The speed sensor 28 may be any device capable of measuring or determining the speed of the marine vessel 41, which may be the speed over water or a GPS-based speed determination. In exemplary embodiments, the speed sensor 28 may include a pitot tube, a paddle wheel, or a global positioning system (GPS) based speed determination module that determines speed based on a change in the GPS coordinates over time.

In yet another embodiment, the baseline resistance amount may be determined based on engine speed, such as an engine speed value received from the ECU 50 associated with the propulsion device 40. For example, a person having ordinary skill in the art will understand that the vessel speed can be approximated based on engine speed. In certain embodiments, the baseline resistance amount may be determined based on a filtered vessel speed value and/or a filtered engine RPM value, such as time-based filter values that reduce the impact of erroneous measurement and/or the effect of noise in the system.

Figure 3A:
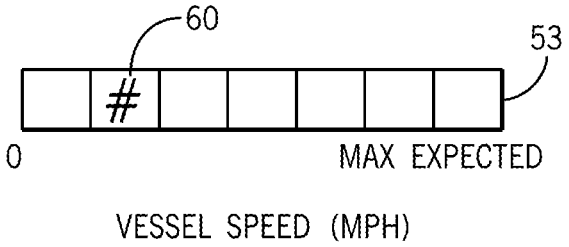
FIGS. 3A-3C schematically depict exemplary lookup tables used by a steering system on a marine vessel to determine a resistance amount.

For example, the baseline resistance amount may be determined by accessing a lookup table based on vessel speed or engine RPM, which again may be filtered values. FIG. 3A exemplifies one embodiment of a lookup table 53 providing baseline resistance amounts 60 based on vessel speed in miles per hour. In the exemplary lookup table 53, baseline resistance amounts 60 are provided at speed increments ranging from 0 miles per hour to a maximum expected vessel speed for a particular marine vessel. Such increments are calibratable values and could be equal increments or varying increments across the table 53. Accordingly, the baseline resistance provided by the lookup table 53 can be calibrated for particular marine vessel configuration.

If the control unit 3 detects at least a threshold change in angular position of the marine vessel, then it acts to prevent a decrease in the resistance amount actuated on the steering shaft 16 by the variable resistance device 17, and may also apply a resistance increase as described herein. As described above, vessel speed and/or engine speed may decrease in conditions where the angular position of the marine vessel is in flux, such as in a turn or when the vessel is going over waves. In such events, if no intermediate action is taken, the resistance amount applied to the steering wheel 5 will decrease due to the decrease in vessel speed. Such a decrease in resistance amount is undesirable and would not be expected by a user in such unsteady conditions. Accordingly, upon detecting a threshold change in angular position, such as based on the inertial measurement output from the IMU 20, the control unit 3 acts to hold the baseline resistance amount until the threshold change in angular position is no longer exceeded, or until the threshold change in angular position is no longer exceeded for at least a predetermined amount of time. Thereby, the baseline resistance amount determined at the time of detecting the threshold change in angular position is held throughout the entire event, such as the tilt of the marine vessel in a turn or the rocking of the marine vessel 41 as it goes over a wave. The period of time for determining when the event causing the threshold change in angular position is over may be an amount calibratable for a particular marine vessel and/or its intended use.

The threshold change in angular position may take any of various forms and may be a calibratable value based on the configuration of a particular marine vessel 41. For example, the threshold change in angular position may be a predetermined change in one or more of a pitch, roll, or yaw, such as determined based on the output of the IMU 20 or another angular position sensor. For example, the threshold change in angular position may include differing threshold amounts for changes in pitch, changes in roll, and changes in yaw. Alternatively or additionally, the threshold change in angular position may be based on a calculated value that accounts for pitch, roll, and yaw, such as a g-force value. In such an embodiment, the threshold change in angular position may be a threshold change in the calculated value, such as a threshold change in g-force.

The control unit 3 may determine or calculate a resistance increase based on the measured angular position, such as the inertial measurement output from the IMU 20. For example, the control unit 3 may calculate a resistance increase based on a change in at least one of the pitch, roll, and yaw measured by the IMU 20. The resistance increase is an additional resistance amount added to the baseline resistance amount while the angular position is changing by more than the threshold amount. The resistance increase may be calculated based on a change in angular position of the marine vessel 41 with respect to any one or more of the three coordinates. In another embodiment, the resistance increase may be determined based on a calculated value, such as g-force or centrifugal force experienced at a point on the marine vessel, which is calculated based on the pitch, roll, and yaw measured by the IMU 20.

Figure 3B:
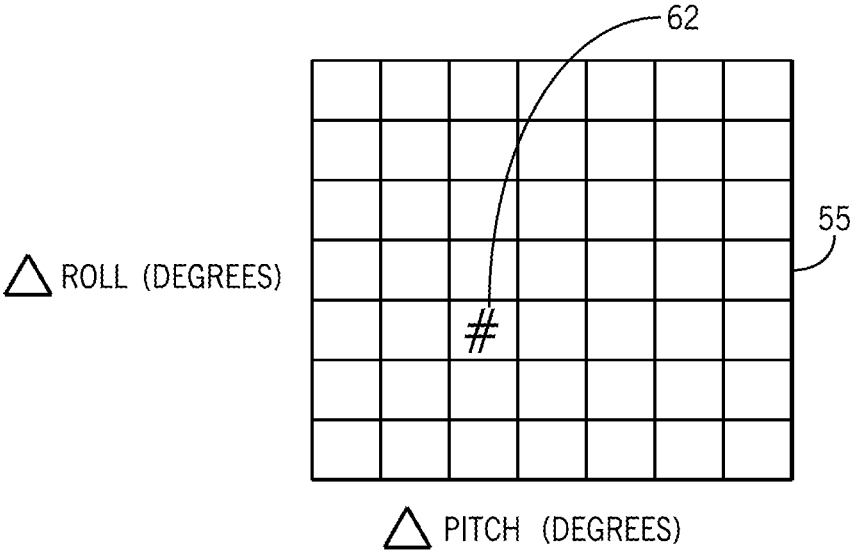

The resistance increase may be calculated by accessing a lookup table correlating resistance increase values to changes in angular position. FIG. 3B provides one exemplary embodiment of a lookup table 55 correlating resistance increase values 62 based on changes in angular position. In the depicted example, the lookup table 55 is a two-dimensional lookup table providing resistance increase values 62 based on pitch change values and roll change values, measured in degrees. In another embodiment, the lookup table 55 could be a three-dimensional lookup table also correlating resistance increase values 62 to a yaw change values. In other embodiments, the lookup table 55 could be a one-dimensional table correlating resistance increase values 62 to just one of a change in pitch, roll, or yaw. In still other embodiments, the lookup table 55 may also correlate resistance increase values 62 to a change in g-force calculated based on the inertial measurement output.

In certain embodiments, the resistance amount determined by the control unit 3 may also account for a condition where a sudden decrease in engine load is detected. For example, a threshold decrease in engine load may be detected as a threshold change in throttle position, a threshold change in intake manifold absolute pressure, or a threshold change in intake mass flow rate in the intake manifold within the propulsion device 40. For example, the controller 3 may receive input from one or more sensors associated with the propulsion device 40 providing values that indicate engine load, such as a throttle position sensor 22, a mass air flow sensor 24, and/or a manifold absolute pressure sensor 26. The position of the throttle valve in the propulsion device 40 is varied to allow more or less air into the intake manifold of the engine. A throttle position (TP) sensor 22 senses and provides information regarding the position of the throttle valve metering air intake into the internal combustion engine in the propulsion device 40. The mass air flow (MAF) sensor 24 provides information to the control unit 3 regarding the mass flow rate of air entering the engine in the propulsion device 40. For example, the MAF sensor 24 may be a "hotwire" sensor located in the air duct leading to the throttle body and positioned to sense the air volume and density entering the intake manifold. The manifold absolute pressure (MAP) sensor 26 may be any type of pressure sensor capable of providing information to the control unit 3 representative of manifold absolute pressure. A change in engine load on the propulsion device 40 is reflected in the values measured by the TP sensor 22, MAP sensor 26, and MAF sensor 24. For example, a sudden decrease in engine load may be indicated by a sudden closing of the throttle valve and a corresponding decrease in intake mass flow rate and a decrease in manifold pressure. For example, such an event may indicate cavitation or a prop venting event (i.e. some or all of the propeller is above the water surface), or some other situation where there is a sudden decrease in resistance on the propeller.

Figure 3C:
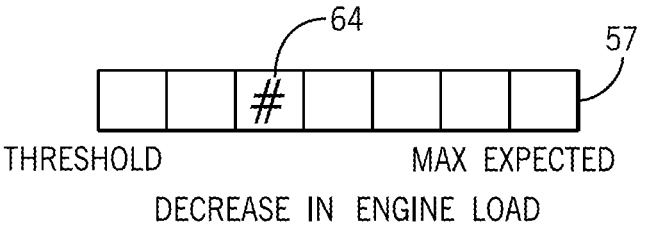

The control unit 3 may determine an additional resistance increase upon detection of the threshold decrease in engine load. The resistance amount calculated by the control unit 3 and effectuated by the variable resistance device 17 would then be determined as the baseline resistance amount, plus the resistance increase determined based on the change in angular position, plus the additional resistance increase determined based on the decrease in engine load. For example, the additional resistance increase may be determined by accessing a lookup table correlating additional resistance increase values to values indicating a decrease in engine load, such as a change in the sensed throttle position, a decrease in mass airflow, or a decrease in manifold absolute pressure, as is described above. FIG. 3C exemplifies a lookup table 57 correlating additional resistance increase values 64 to values indicating a decrease in engine load, which could include any one or more of the above described values.

Referring to FIG. 2, the control unit 3 communicates with each of the one or more components of the system 1 via a communication link 43, which can be any wired or wireless link. The control unit 3 is capable of receiving information and/or controlling one or more operational characteristics of the system 1 and its various sub-systems by sending and receiving control signals via the communication links 43. In one example, the communication links 43 are embodied as a controller area network (CAN) bus, but other types of wired or wireless links may be used. It should be noted that the extent of connections and the communication links 43 may in fact be one or more shared connections, or links, among some or all of the components in the system. Moreover, the communication link 43 lines are meant only to demonstrate that the various control elements are capable of communicating with one another, and do not represent actual wiring connections between the various elements, nor do they represent the only paths of communication between the elements. Additionally, the system 1 may incorporate various types of communication devices and systems, and thus illustrated communication links 43 may in fact represent various different types of wireless and/or wired data communication systems.

The methods described herein are implemented by a control unit 3, which in the depicted embodiment is represented as including memory 38 and a programmable processor 37. In other embodiments of the steering system 1, the functions of the control unit 3 and/or the ECU 50 may be provided with fewer control units or more control units than in the depicted embodiment. For instance, another exemplary steering system 1 may incorporate multiple control units 3 that are communicatively connected and cooperate to provide the control functions described herein. In other embodiments, some or all of the control functions described in the exemplary embodiments as performed by the control unit 3 may be provided by and incorporated into the ECU 50.

The systems and methods described herein may be implemented with one or more computer programs executed by one or more processors, which may all operate as part of a single control unit 3. The computer programs include processor-executable instructions that are stored on a non-transitory tangible computer readable medium, such as memory 38. The computer programs may also include stored data. Non-limiting examples of the non-transitory tangible computer readable medium are nonvolatile memory, magnetic storage, and optical storage.

As used herein, the term control unit may refer to, be part of, or include an application-specific integrated circuit (ASIC), an electronic circuit, a combinational logic circuit, a field programmable gate array (FPGA), a processor (shared, dedicated, or group) that executes code, or other suitable components that provide the described functionality, or a combination of some or all of the above, such as in a system-on-chip. The term control unit may include memory 38 (shared, dedicated, or group) that stores code executed by the processor 37. The term code, as used herein, may include software, firmware, and/or microcode, and may refer to programs, routines, functions, classes, and/or objects. The term shared, as used above, means that some or all code from multiple control units may be executed using a single (shared) processor. In addition, some or all code to be executed by multiple different processors may be stored by a single (shared) memory. The term group, as used above, means that some or all code comprising part of a single control unit may be executed using a group of processors. Likewise, some or all code comprising a single control unit may be stored using a group of memories.

Figure 4:
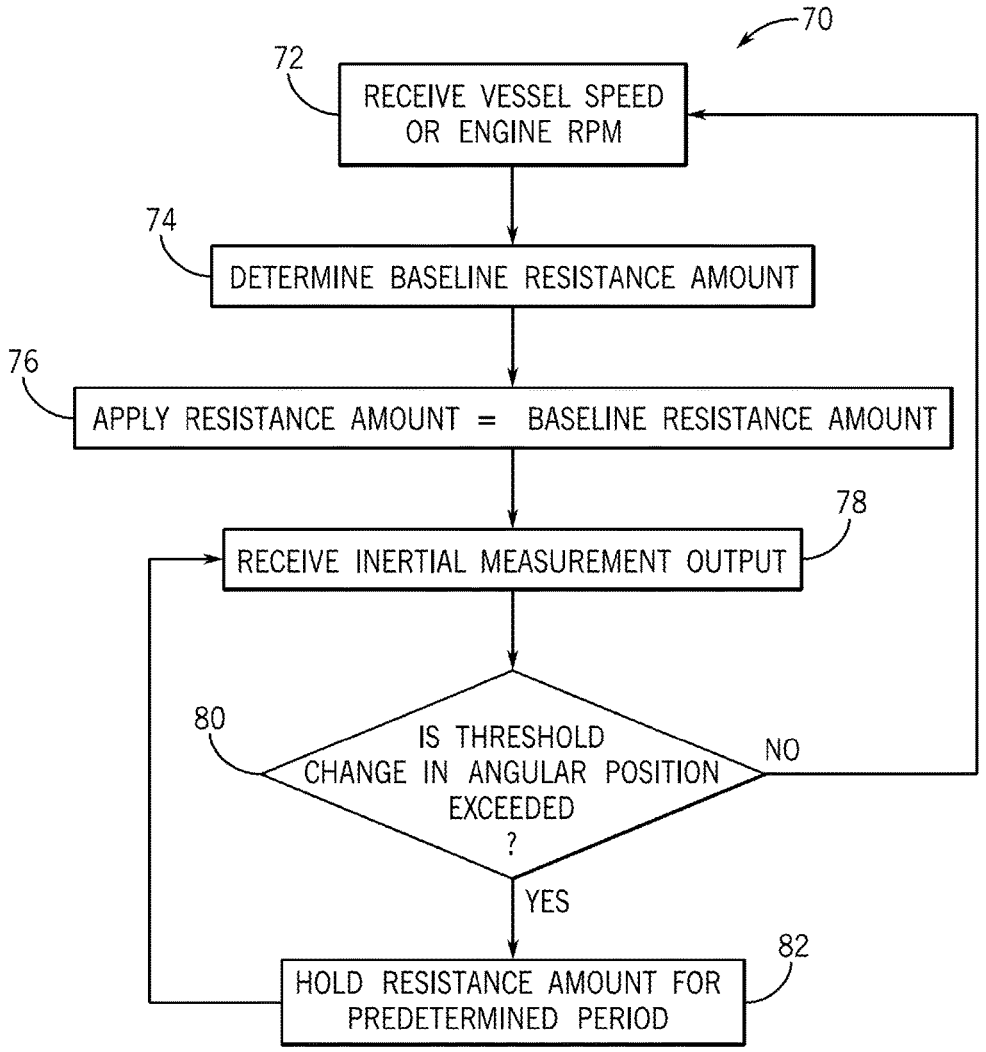
FIG. 4 is a flow diagram depicting one embodiment of a method of providing steering feedback on a steering wheel of a marine vessel.

FIG. 4 is a flowchart depicting one embodiment of a method 70 of providing steering feedback on a steering wheel 5 of a marine vessel 41. A vessel speed or engine RPM is received at step 72 and a baseline resistance amount is determined at step 74 based on the vessel speed and/or the engine RPM. The variable resistance device 17 is then controlled at step 76 to apply a resistance amount equal to the baseline resistance amount. An inertial measurement output is received at step 78, such as from an IMU 20 or other type of angular position sensor and/or angular motion sensor. Instructions are then executed at step 80 to determine whether a threshold change in angular position is exceeded, such as whether the inertial measurement output received at step 78 has changed by more than a predetermined amount over a predetermined amount of time. If the threshold change in angular position is not exceeded then the control unit 3 returns to step 72 and re-executes the above-described steps. Once the threshold change in angular position is exceeded the resistance amount is held at step 82 for a predetermined period of time. Meanwhile, step 78 and 80 are re-executed to determine whether the inertial measurement output continues to exceed the threshold change in angular position. The predetermined period may be a calibratable amount of time determined to ensure that the steering resistance is not reduced until the event causing the threshold change in angular position is completed.

FIG. 5 depicts another embodiment of a method 70 for providing steering feedback on a steering wheel 5 of a marine vessel 41. Steps 72 through 80 are executed to determine the baseline resistance amount and detect at least a threshold change in angular position, as is described above. If a threshold change in angular position is detected, the baseline resistance amount is stored at step 81, and then a resistance increase is determined at step 83 based on the change in the angular position, such as based on a change in at least one of the pitch, roll, or yaw position of the marine vessel 41. In certain embodiments, the resistance increase is added to the baseline resistance amount, and then the method returns to step 78 to determine whether the threshold change in angular position is exceeded.

In the depicted embodiment, further steps are executed to determine whether an additional resistance increase is warranted in view of a change in engine load. Step 85 is executed to determine whether a sudden decrease in engine load has occurred. As described above, engine load may be determined based on any number of one or more values measured from the engine of the propulsion device 40, such as a change in throttle position, a change in mass airflow, and/or a change in manifold absolute pressure. If no sudden decrease in engine load is detected, the resistance amount is determined at step 87 to be the baseline resistance amount plus the resistance increase determined at step 83. A saturation point may be set based on the capabilities of the resistance device 17 incorporated in the steering system 1. Accordingly, the resistance amount determination at step 87 may be saturated at 100% of the amount of resistance that can be reliably exerted by the variable resistance device 17 to prevent rotation of the steering wheel 5.

If the sudden decrease in engine load is detected at step 85, then step 86 is executed to determine an additional resistance increase based on the decrease in engine load, or the change in the value indicating engine load. The resistance amount is then calculated at step 88 as the baseline resistance amount, plus the resistance increase, plus the additional resistance increase, wherein a saturation point is set at 100% of the capability of the variable resistance device 17. The resistance amount is then applied at step 89, and the system returns to step 78 to determine whether the threshold change in angular position is still occurring. Once it is determined at step 80 that the threshold change in angular position is no longer exceeded, then the system may return to step 72 to redetermine the baseline resistance amount based on the vessel speed and/or the engine RPM. In other embodiments, the resistance amount calculated at steps 87 or 88 may be held for a predetermined amount of time after determining that the threshold angular position is not exceeded, such as to verify that a predetermined number of inertial measurement output values are below the threshold change in angular position.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A steering system on a marine vessel, the steering system comprising:

a steering wheel movable by a vessel operator to steer the marine vessel;

a variable resistance device controllable to apply a variable resistance amount to resist movement of the steering wheel;

a control unit that controls the variable resistance device, the control unit configured to:

determine a resistance amount based on vessel speed and/or engine revolutions per minute (RPM), wherein the resistance amount is greater than zero;

control the variable resistance device to apply the resistance amount to resist movement of the steering wheel based on vessel speed and/or engine RPM;

detect at least a threshold change in angular position of the marine vessel;

determine a baseline resistance amount based on the resistance amount at a time of detecting the threshold change in angular position; and control the variable resistance device to prevent a decrease in the variable resistance amount below the baseline resistance amount.

2. The steering system of claim 1, further comprising:

an inertial measurement unit (IMU) that provides an inertial measurement output to the control unit;

wherein the control unit detects the threshold change in angular position based on the inertial measurement output by detecting that a change in at least one of a pitch, roll, and yaw of the marine vessel exceeds the threshold change.

3. The steering system of claim 2, wherein the control unit is further configured to:

determine a resistance increase based on the change in at least one of the pitch, roll, and yaw; and control the variable resistance device to apply the variable resistance amount, wherein the variable resistance amount is greater than or equal to the baseline resistance amount plus the resistance increase.

4. The steering system of claim 3, further comprising a lookup table correlating resistance increase values to values representing change in at least one of pitch, roll, and yaw.

5. The steering system of claim 3, wherein the variable resistance device is controlled to apply the resistance increase until the inertial measurement output of the IMU indicates that the threshold change in angular position is no longer exceeded.

6. The steering system of claim 3, wherein the control unit is further configured to:

detect at least a threshold decrease in engine load;

determine an additional resistance increase based on the decrease in engine load; and wherein the variable resistance amount is greater than or equal to the baseline resistance amount, plus the resistance increase, plus the additional resistance increase.

7. The steering system of claim 1, wherein the control unit is further configured to prevent the decrease in the variable resistance amount until the threshold change in angular position of the marine vessel is not exceeded for a predetermined period of time.

8. The steering system of claim 1, wherein the variable resistance amount is applied by the variable resistance device to equally resist movement of the steering wheel in both rotational directions.

9. The steering system of claim 1, wherein the resistance amount is determined based on a filtered vessel speed value and/or a filtered engine RPM value.

10. The steering system of claim 1, wherein the control unit is further configured to:

detect at least a threshold change in engine load; and adjust the variable resistance amount applied by the variable resistance device based on the change in engine load.

11. A method of providing steering feedback on a steering wheel of a marine vessel, the method comprising:

with a control unit:

determining a resistance amount based on vessel speed and/or engine revolutions per minute (RPM), wherein the resistance amount is greater than zero;

controlling a variable resistance device to apply the resistance amount to resist movement of the steering wheel;

detecting at least a threshold change in angular position of the marine vessel;

determining a baseline resistance amount based on the resistance amount at a time of detecting the threshold change in angular position; and controlling the variable resistance device so as to prevent a decrease in the variable resistance amount below the baseline resistance amount.

12. The method of claim 11, further comprising, with the control unit:

receiving an inertial measurement output from an inertial measurement unit (IMU);

wherein the step of detecting the threshold change in angular position includes detecting, based on the inertial measurement output, that a change in at least one of a pitch, roll, and yaw of the marine vessel exceeds the threshold change in angular position.

13. The method of claim 12, further comprising, with the control unit:

determining a resistance increase based on the change in at least one of the pitch, roll, and yaw; and wherein the variable resistance amount applied by the variable resistance device is greater than or equal to the baseline resistance amount plus the resistance increase.

14. The method of claim 13, wherein determining the resistance increase includes accessing, with the control unit a lookup table correlating resistance increase values with values representing change in at least one of pitch, roll, and yaw.

15. The method of claim 13, further comprising, with the control unit, controlling the variable resistance device to apply the resistance increase until the inertial measurement output indicates that the threshold change in angular position is no longer exceeded.

16. The method of claim 15, further comprising, with the control unit, controlling the variable resistance device to apply the resistance increase until the inertial measurement output indicates that the threshold change in angular position is not exceeded for a predetermined period of time.

17. The method of claim 13, further comprising, with the control unit:

detecting at least a threshold decrease in engine load;

determining an engine load resistance value based on the decrease in engine load;

wherein the variable resistance amount applied by the variable resistance device is greater than or equal to the baseline resistance amount, plus the resistance increase, plus the engine load resistance value.

18. The method of claim 13, further comprising, with the control unit, controlling the variable resistance device to apply the variable resistance amount greater than or equal to the baseline resistance amount until the threshold change in angular position is not exceeded for a predetermined period of time.

19. The method of claim 11, wherein the resistance amount is determined, with the control unit, based on a filtered vessel speed value and/or a filtered engine RPM value.

20. The method of claim 11, further comprising, with the control unit:

detecting at least a threshold change in engine load; and adjusting the variable resistance amount applied by the variable resistance device based on the change in engine load.

* * * * *